United States Patent [19]

Debs

[11] 4,214,622

[45] Jul. 29, 1980

[54] VERTICAL BLIND

[75] Inventor: Victor Debs, Staten Island, N.Y.

[73] Assignee: Levolor Lorentzen, Inc., Hoboken, N.J.

[21] Appl. No.: 921,048

[22] Filed: Jun. 30, 1978

[51] Int. Cl.[2] ..... E06B 9/30

[52] U.S. Cl. ..... 160/168 A; 160/176 R

[58] Field of Search ..... 160/166–178 R, 160/320

[56] References Cited

U.S. PATENT DOCUMENTS

| | | | |
|---|---|---|---|
| 1,550,237 | 8/1925 | Beckman | 160/320 |
| 2,659,430 | 11/1953 | Lorentzen | 160/173 |
| 2,849,063 | 8/1958 | Achler et al. | 160/177 |
| 3,280,891 | 10/1966 | Eldredge, Jr. et al. | 160/178 R |
| 3,463,219 | 8/1969 | Osterholz | 160/172 |
| 3,630,264 | 12/1971 | Debs | 160/177 |
| 3,878,877 | 4/1975 | Bruneau et al. | 160/168 |
| 3,921,695 | 11/1975 | Debs | 160/177 |
| 4,122,884 | 10/1978 | Salzmann | 160/178 R |
| 4,128,914 | 12/1978 | de Wit | 160/178 R |
| 4,140,169 | 2/1979 | Arena | 160/178 R |

*Primary Examiner*—Peter M. Caun

[57] ABSTRACT

In a vertical blind with a blind head and a number of carriers supported for reciprocating movement in the head, and holders respectively supported in the carriers for pivotal movement and adapted to support a plurality of vertical vanes therefrom, with a control for controlling the reciprocating movement of the carriers and the pivotal movement of the holders including a tilt rod: first bevel gears respectively rotatably supported in the carriers and mounted for rotation with the tilt rod, and second bevel gears respectively connected to the holders and respectively mounted for meshing engagement with the first bevel gears. The carriers are interconnected by special spacer bands and have special openings for receiving the cord for traversing or drawing the blind.

34 Claims, 34 Drawing Figures

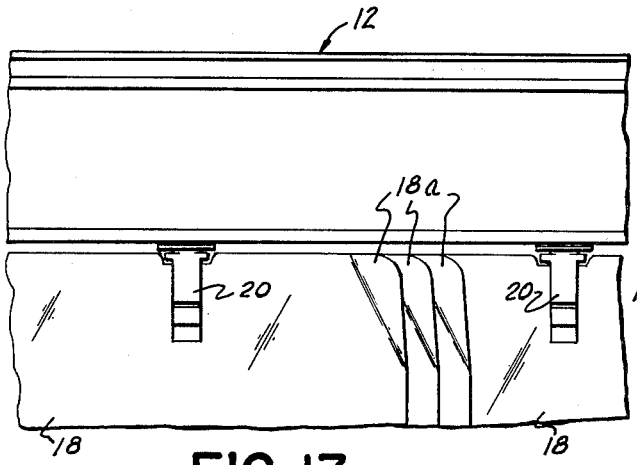
FIG. 13
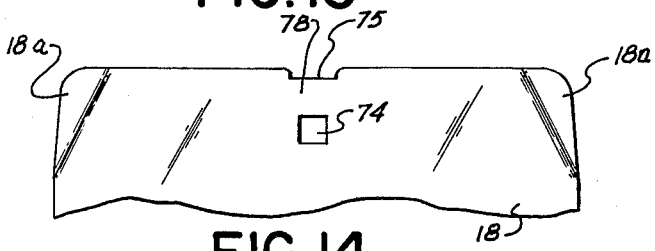
FIG. 14
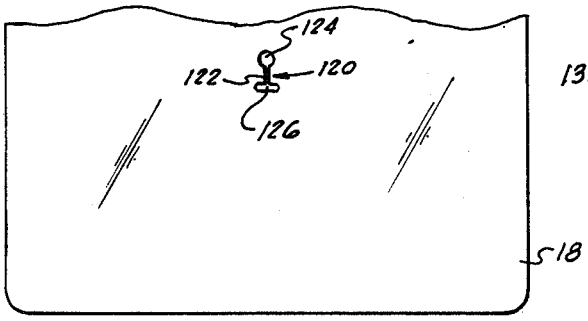
FIG. 15
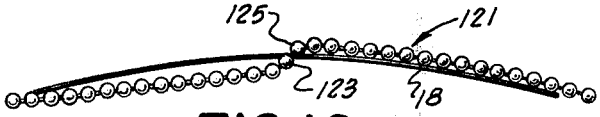
FIG. 16
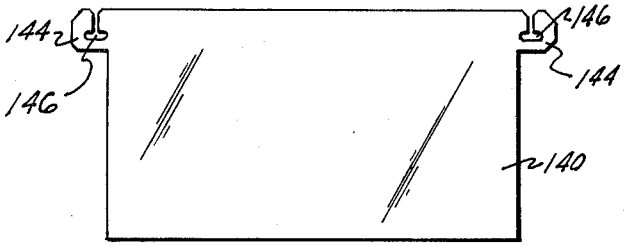
FIG. 20
FIG. 17
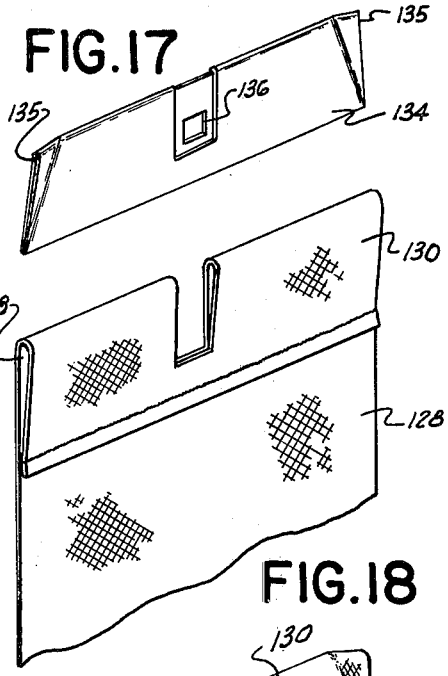
FIG. 18
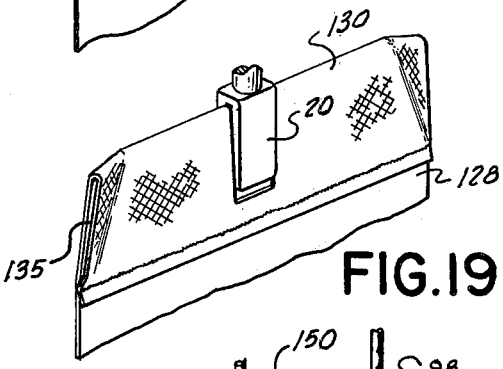
FIG. 19
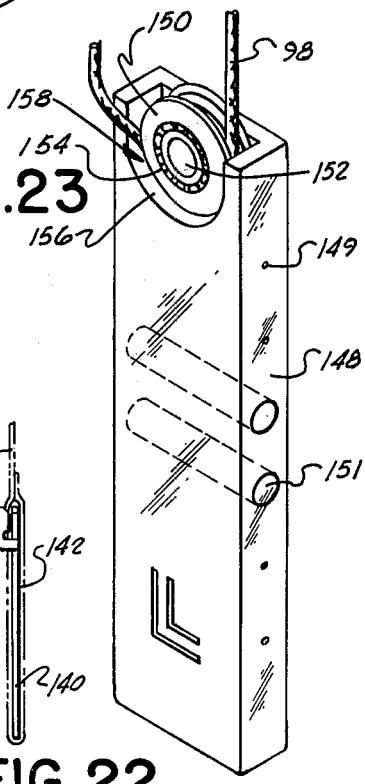
FIG. 23
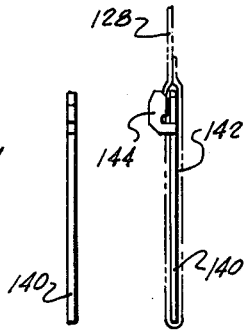
FIG. 21 FIG. 22

VERTICAL BLIND

BACKGROUND OF THE INVENTION

The present invention relates to a vertical blind, and more specifically to a vertical blind of this type which has several novel and improved features with respect to heretofore known vertical blinds.

It is an object of the present invention to provide improved control mechanisms for tilting the vanes, louvers or slats of a vertical blind and for opening and closing the blind.

It is another object of the present invention to provide an improved holder for suspending the vertical blind vanes or slats from carriers within the head of the vertical blind.

It is still another object of the present invention to provide a carrier for supporting a slat or vane holder in a vertical blind which is simplified and improved over such carriers in heretofore known vertical blinds.

A still further object of the present invention consists in providing improved means for connecting a vertical blind head to a support, such as a ceiling.

A still further object of the present invention consists in providing a vertical blind slat or vane with improved means for facilitating closing of the blind.

Still another object of the present invention consists in providing a new and improved control carrier for tilting a wand-operated vertical blind.

A still further object consists in providing an improved weight for placing the traverse cords of a vertical blind under tension.

It is still another object to provide means for keeping the control cords of a vertical blind separated.

It is also an object of the present invention to provide new and improved means for spacing the blind carriers from each other.

BRIEF SUMMARY OF THE INVENTION

The above-mentioned objects have been realized in a vertical blind with a blind head, a number of carriers supported for reciprocating movement in the head and a number of holders respectively supported in the carriers for pivotal movement and adapted to support a number of vanes therefrom, by novel control means for controlling the reciprocating movement of the carriers and the pivotal movement of the holders, including first bevel gears respectively rotatably supported in the carriers and mounted for rotation with the tilt rod of the blind and second bevel gears respectively connected to the holders and mounted for meshing engagement with the first bevel gears. The carriers are interconnected by special spacer bands and have special openings for receiving the draw or traverse cord. Also, a novel intermediate support carrier is provided for supporting the draw or traverse cord in the middle area of the blind head, and a novel weight for taking up the slack of the traverse cord. Still further, the vertical blind according to this invention includes vanes provided with special slots for receiving a chain interconnecting the vanes, and also a cord separator for keeping separated the strands of the tilt cord and of the traverse cord, if they are both located on the same side of the blind head.

BRIEF DESCRIPTION OF PREFERRED EMBODIMENTS OF THE INVENTION

The invention is illustrated, by the way of example, in the accompanying drawings, in which:

FIG. 13 shows an enlarged view of a detail encircled in FIG. 1;

FIGS. 14 and 15 are partial elevational views respectively of the top and bottom part of a vane used in the vertical blind according to FIG. 1;

FIG. 16 is a top view of a vane showing an optional inventive feature;

FIG. 17 illustrates a strip of material used for suspending a blind vane of soft material, such as cloth or fabric from the holder in the blind head;

FIG. 18 shows a vertical blind vane to be combined with the strip shown in FIG. 17;

FIG. 19 shows the strip and vane of FIGS. 17 and 18 combined and engaged by a holder;

FIG. 20 is an elevational view of a weight to be used at the bottom of the vane according to FIG. 18;

FIG. 21 is a side view of the weight shown in FIG. 20;

FIG. 22 is a side view of the combination of the weight according to FIG. 20 with the bottom of the vane according to FIG. 18;

FIG. 23 shows a weight for taking up the slack in a traverse cord of a vertical blind;

DETAILED DESCRIPTION OF PREFERRED EMBODIMENTS OF THE INVENTION

Figure 1:
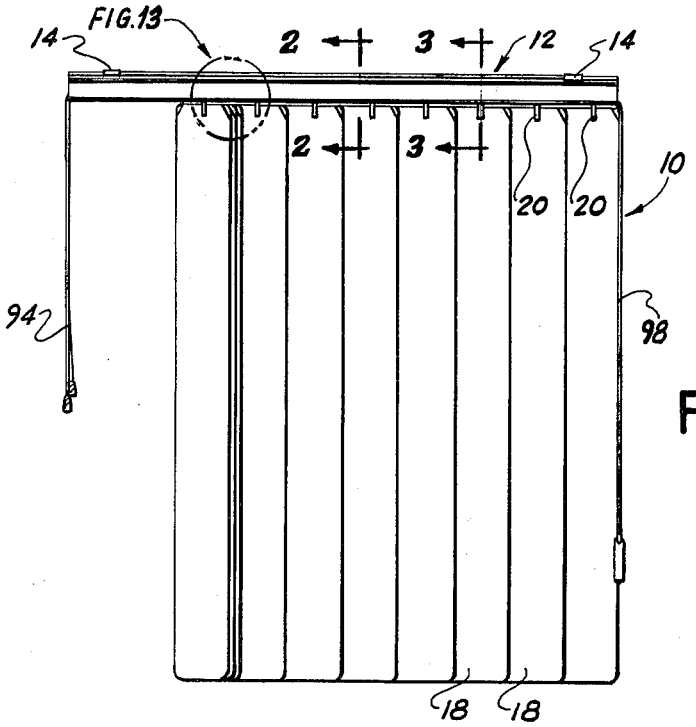
FIG. 1 is an elevational view of a vertical blind embodying the principles of the invention and showing the blind in partially traversed opened position.

Referring now to the drawings in detail, FIGS. 1 to 13 show one embodiment of a vertical blind in accordance with the present invention, generally designated with the reference numeral 10. The vertical blind comprises a head 12 to be suspended from a support, such as a bracket or a support surface, for instance a ceiling, by brackets 14 (FIGS. 2 and 2A) by means of screws 16. The vertical blind further comprises a plurality of vanes or slats 18 which are suspended from holders 20 which in turn are supported in carriers 22 movable within blind head 12.

The vertical blind 10 also comprises means (to be described in detail further below) for tilting the vanes or slats 18 about substantially vertical axes from open to closed position and vice versa, through an infinite number of intermediate positions, and also means for traversing the carriers 22 including the holders 20 and vanes 18, within the length of the blind head, to the right or left, from one end to the other and vice versa through intermediate positions. These controls, for tilting and for traversing the blind are shown in FIGS. 2 through 12 for one embodiment of the invention and will be described in greater detail further below. While in the embodiment shown in FIG. 1 the blind opens from left to right, this is by way of example only. It is, of course, possible to design the blind so that it opens from the left, or from the center (bi-partite blind), for instance.

The blind head 12 is substantially of square across section and comprises a top wall 24, side walls 26 and 28 integral with the top wall, and a bottom wall 30. Each bracket 14 for connecting the head to a support, has an oblong hole 13 for the screw 16 and has a first curved end 15 engaging one edge 24*a* of the head and a second curved end 17 for engaging the opposite edge 24*b* of the head. End 17 is curved back to form a tab 19 to permit insertion of a screw driver between side wall 28 and tab 19 to detach the head from the support.

The blind head may be provided with means for attaching thereto decorative valances 32. In the case illustrated in FIG. 2, the valances 32 are received in grooves 34 formed by longitudinally extending upper and lower protrusions 36 in front and back of the head. Bottom wall 30 has a relatively wide slot 31 and provides a sliding surface or rail for the carriers 22.

Each carrier comprises end walls 38 and side walls 40 and is molded from a suitable plastic material. Carrier 22 is provided with grooves 42 which permit the carrier to be inserted in head 12 so that it may rest at 43 on the bottom wall 30 of the blind head 12. Carrier 22 is also provided with a substantially rectangular opening 44 through which the holder 20 can be inserted from the top, and a slot 46 for a purpose to be described further below. Carrier 22 provides a seat 48 and a circumferential support 50 for holder 20.

Figure 6:
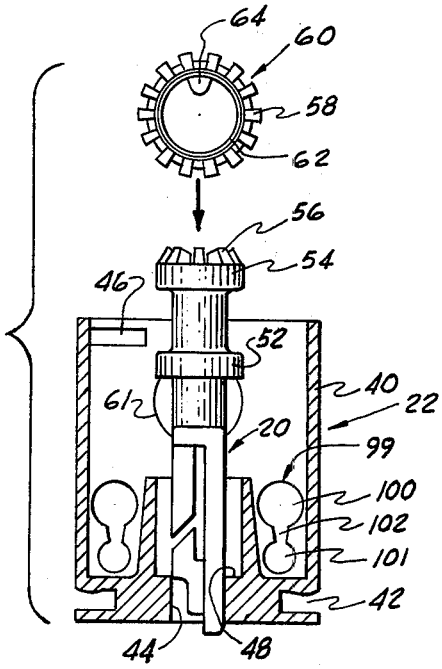
FIG. 6 is an exploded partial section of the carrier shown in FIG. 3.

As shown in FIG. 6, during assembly the holder 20 is introduced from the top until it rests with a seat 52 on seat 48 of carrier 22. Holder 20 also comprises a bevel gear 54 provided with teeth 56 which are adapted to mesh with teeth 58 of a bevel gear 60 which is likewise introduced into carrier 22 from the top, as shown in FIG. 6, until it snaps into two opposite circular openings 61 in carrier 22, with seats 62. Gear 60 is provided with a key 64 for a purpose to be described later.

Holder 20 is likewise made from a suitable plastic material. In addition to the gear 54 and seat 52, the holder comprises a first shank 66 which in its operative position extends substantially vertically, a second shank 68 extending substantially parallel to shank 66, and a hook-like portion 70 extending from shank 66. Shanks 66 and 68 form therebetween a slot 72. The holder is also provided with a slot 76 which extends at an acute angle, preferably of about 45°, with respect to slot 72.

Slot 72 receives the upper portion of a vane 18. More specifically, as shown in FIG. 14, the vane 18 is provided with an opening 74. During assembly a portion 78 between opening 74 and the top edge 75 of vane 18 is passed through slot 76 into slot 72 and comes to rest in the lower portion 73 of slot 72 on portion 70. The arrangement is such that vane 18 can easily be introduced through the inclined slot 76, but once it is received in the lower portion 73 of slot 72 it cannot be dislodged easily from the slot. In this way, accidental or casual removal of the vane 18 from the holder 20 is prevented, while nevertheless the vane can be removed if this should be necessary for cleaning or replacement, by lifting the vane 18 until the lower edge of portion 78 passes beyond the upper edge 71 of portion 70.

Figure 2:
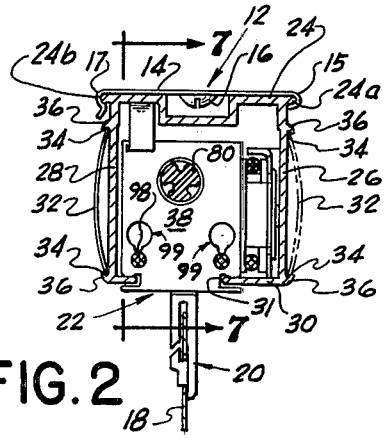
FIG. 2 is an enlarged section through the blind head taken along line 2—2 of FIG. 1 and showing a carrier supporting a vane in the head.
Figure 2A:
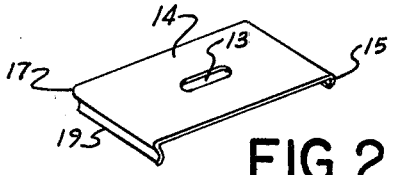
FIG. 2A is a perspective view of a plate for connecting the blind head to a support such as a bracket or overhead support surface or ceiling.
Figure 5:
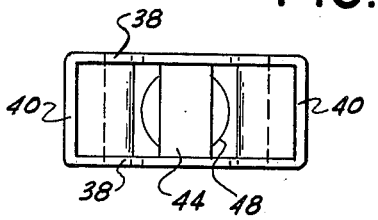
FIG. 5 is a top view of FIG. 3, with some components omitted.
Figures 7, 8A, 8B, 9, 10, 11, 12:
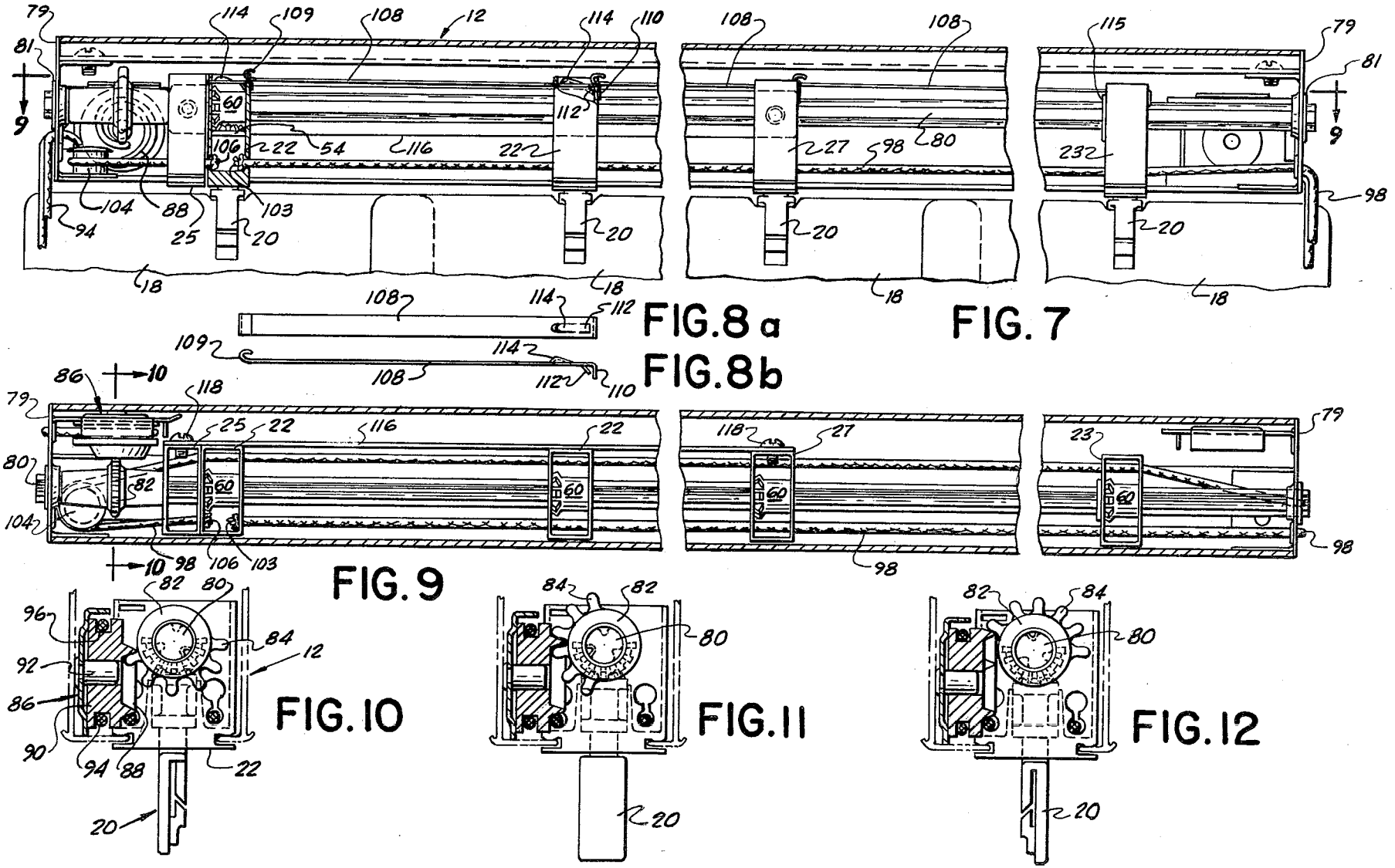
FIG. 7 is a longitudinal section through the blind head taken along the line 7—7 of FIG. 2.
FIG. 8A is a top view of a spacer strip for use between adjacent carriers.
FIG. 8B is a side view of the spacer strip of FIG. 8A.
FIG. 9 is a longitudinal section through the blind head, taken along the line 9—9 of FIG. 7.
FIG. 10 is a section taken along the line 10—10 of FIG. 9 showing the blind tilter when the vanes of the blind are tilted to closed position.
FIG. 11 is a section similar to that of FIG. 10, but showing the tilter when the vanes of the vertical blind are tilted to open position.
FIG. 12 is a cross-section similar to that of FIG. 10, but showing the tilter when the vanes of the blind are tilted closed in a position approximately 180° turned from that of FIG. 10.

FIGS. 7 and 9 represent longitudinal sections through the vertical blind head 12. A number of carriers arranged within head 12—number of course depends on the width of the blind—for supporting an equal number of vertically extending vanes 18, as shown in FIG. 1. Only four such carriers are shown in FIGS. 7 and 9. Almost all of the carriers have the form of the carriers designated with reference numeral 22, but there are three special carriers 23, 25 and 27, the purpose of which will be explained further below.

A tilt rod 80 is rotatably supported at 81 in end brackets 79 of head 12 and extends through each gear 60 in each carrier. Rotation of tilt rod 80, by means to be described later, causes rotation of gear 60 in view of key 64 and thereby of gear 54 which in turn rotates the holder 20 and respective vane 18.

Adjacent one end of the vertical blind head 12 the tilt rod 80 is provided with a gear 82 with teeth 84 (FIGS. 9 to 12). The means for oscillating the tilt rod 80 is generally designated with 86 and comprises a disc 90 with a spiral thread 88 on the face of disc 90, forming a worm. Disc 90 is rotatable about a pin 92 by means of a tilt cord 94 passed around a groove 96 in disc 90. As clearly shown in FIGS. 10 to 12, rotation of disc 90 by the tilt cord 94 will cause the worm 88 to rotate gear 82. Teeth 84 do extend over a limited portion of the circumference of gear 82 only so as to prevent damage to gear 82 if a person operating cord 94 continues to pull at the cord after the vanes 18 have reached their fully closed positions. The selection of the number of teeth is such that once the vanes have reached either end position, gear 82 runs out of mesh with worm 88 (see FIGS. 10 and 12). To prevent the opposite ends of the cord from being pulled up out of reach beads 95, 95*a* are attached to the branches of the cord, which beads also serve for keeping the branches synchronized with the vanes. In connection with horizontal venetian blinds this is described in U.S. Pat. No. 2,174,994 where the problems involved are similar.

Traverse of the vertical blind to fully open or fully closed position, i.e. movement of the vanes 18 to the right or left in FIG. 1, is effected by means of a cord 98 (see FIGS. 1, 7 and 9) which passes through all carriers 22, 23, 25 and 27, and more specifically through openings 99 therein. Openings 99 (FIG. 6) are of a special design. They comprise an upper circular portion 100, a lower circular portion 101 of smaller diameter than portion 100, and a portion 102 interconnecting portions 100 and 101 and tapering downwardly. Thus, the openings form a keyway for cord 98. One end 103 of cord 98 is affixed to the next to the last carrier on the left, that is in case the blind opens to the right. The cord passes on one side of each carrier outwardly to the right and returns through the other side of all carriers and around a pin 104 and is finally affixed at its other end 106 to the opposite side of the next to the last carrier on the left-hand side. The reverse applies if the blind opens to the left, i.e. the ends 103 and 106 would be affixed to the next to the last carrier on the right. This carrier could also be one of two center carriers in a bi-partite vertical blind where the vanes are traversed open and closed from the center.

The cord 98 has a core made of a material which does not stretch to an appreciable degree and does not melt, such as rayon, and also has a braided or woven cover of an abrasion resistant material, such as polyester or nylon, but which melts, when sufficient heat is applied.

During assembly of the blind, the ends of cord 98 are subjected to heat so that the cover melts into the core and locks the same to the core. This also will result in an enlarged end or "glob" of a diameter larger than opening portion 101 but smaller than portion 100. Thus, the ends 103 and 106 can be introduced through openings 100 into the carrier in question, such as the next to last carrier on the left in FIGS. 7 and 9. The cord is then forced downwardly through portion 102 into opening portion 101 and the ends 103 and 106 respectively come to rest against opposite walls 38 of the carrier. Even a large force exerted on the cord will not tear the end "globs" off and will not be able to move the cord from opening portion 101 into portion 100. The cord can be removed, however, by cutting ends 103 and/or 106 off. Due to these features of the carrier and cord arrangement according to the present invention, all carriers can directly abut each other with their end walls and will have equal spacing, since no cord ends protrude from the cord connecting carrier.

Spacer bands 108 extend between adjacent carriers, as clearly shown in FIG. 7. Each spacer band 108 has a curved end portion 109 which passes through slot 46 in one end wall of one carrier. Each spacer band has also an end portion 110 which is bent substantially at right angles to the major extension of spacer band 108 and which passes through both slots 46 in the end walls of the adjacent carrier. In order to hold the spacer band to the respective carrier, a portion 112 has been partially punched out of the main body of the spacer band 108 and bent downwardly so that the one end wall 38 of the respective carrier extends between portions 110 and 112 of spacer band 108. The spacer band is also provided with a portion 114 bent out of the plane of the spacer band, for instance by deep drawing or the like. In this way a smooth "hill" is formed.

As mentioned above, in addition to the carriers 22, the vertical blind 10 comprises special carriers 23, 25 and 27. The carrier 23 at the extreme right (when the blind is operated from the right) is held stationary by a retainer ring 115, but in all other respects it conforms to carriers 22, i.e. it is provided with a gear 60 for rotating the holder 20 suspended therefrom. Carrier 25 at the extreme left is movable along bottom wall 30 of head 12, but it has no gear, no holder and no vane attached thereto.

When opening the vertical blind from its closed position, shown in FIG. 7, pulling at cord 98 will cause the last carrier 22 on the left, i.e. the carrier 22 next to carrier 25—since it is the one engaged by end 103 of the cord—to move along head 12 to the right until it abuts the next carrier 22. During this movement spacer 108 will pass through the opening 46 in the last carrier 22 on the left, being pushed upwardly by bent, smooth portion 114 out of the way of the opposite wall 38. Upon further pulling at cord 98 the two left-hand carriers 22 will engage the third and will cause the same to move to the right. This movement may continue until the rightward moving carriers 22 reach the special carrier 27 which is connected to carrier 25 via a link 116 screwed respectively to carriers 27 and 25 by means of screws 118. This will cause carrier 25 to move to the right and provide an intermediate support for the horizontal run of both branches of cord 98. Such intermediate support is optional for smaller blinds, but becomes increasingly important in wider blinds, i.e. blinds wider than about 48 inches. The blind is open completely when all carriers 22 (and carrier 27) have moved to the extreme right and reach carrier 23.

When drawing the vertical blind closed, the extreme left carrier 22 will start moving to the left—since it is engaged by end 106 of the cord—and upon reaching a certain distance will pull the next carrier 22 to the right thereof once the hook portion 109 returns to the end wall 38 adjacent slot 46. The other carriers will be moved to the left one by one upon respective engagement by the hook portion 109. When carrier 27 is being pulled to the left it pushes ahead of itself the intermediate support carrier 25 until the same reaches its end position.

As shown in the left-hand portion of FIG. 1 and in FIGS. 13 and 14, the vanes 18 may be provided with bent upper corners 18*a*, on either one side or both, to facilitate drawing the blind open with the vanes 18 closed. In this way the corners of the vanes do not become caught under holder 20 of the next vane.

Figure 4:
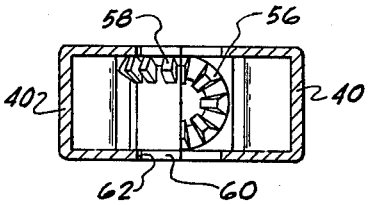
FIG. 4 is a section taken along the line 4—4 of FIG. 3.
Figure 3:
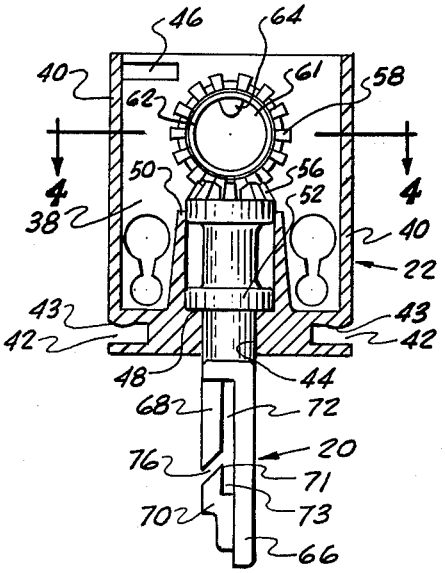
FIG. 3 is an enlarged cross-section taken along line 3—3 of FIG. 1, with the blind head and some components of the carrier omitted for clarity.

FIG. 15 illustrates the bottom portion of a vane 18, the upper end of which is shown in FIG. 4 and has been described previously. The lower end of vane 18 is provided with a slot 120 having a narrow portion 122, a widened upper portion 123, preferably circular, and a widended lower portion 126 which is preferably rectangular, with the major extension in horizontal direction. A chain 121 (see FIG. 16) is passed through the slots 120 in order to keep the vanes 18 from moving too far away from each other while at the same time giving the vanes sufficient freedom to move within a normal range. When assembling the blind the chain is passed through the holes 124, and when appropriately spaced the string or wire between adjacent beads 123,125 is forced through portion 122 into portion 126. The purpose of widening portion 126 is to enable the chain 121 to pass as closely as possible to vane 18 and not along a wide arc which would be the case if portion 126 were circular and of smaller diameter than portion 124.

A modified vane is shown in FIGS. 17 through 22. This vane 128 is made of a flexible material, such as for instance fabric or cloth. It is over-lapped at the upper end as shown at 130 and is provided with a cut-out 132. A strip 134, for instance of aluminum, with a hole 136, similar to hole 74 shown in connection with vane 18, may be passed through opening 138 at either end of the folded section 130. This enables a holder 20 as described previously to engage the strip 134 at the opening 132 to connect the vane to the respective carrier 22, 25 or 27, as previously described. Strip 134 may be provided with bent edges 135, although in most applications this may not be necessary.

FIG. 20 shows a weight 140 which is inserted in a lower folded portion 142 of vane 128. Weight 140 is provided with ears 144 having slots 146 similar to slots 120 in the vanes 18 and for the same purpose, namely for receiving a chain similar to chain 121 shown in FIG. 16. The ears 144 may be bent as shown in FIG. 22 to prevent the weight 140 from being accidentally removed from vane 128.

FIG. 23 shows a weight 148 to be attached to cord 98 in order to take up any slack over the length of the blind head. Cord 98 might otherwise interfere with the proper operation of the blind. Weight 148 comprises a wheel 150 which is rotatably supported on a pin 152 by means of a ball bearing indicated at 154. A small gap 156 is left between the actual body of weight 148 and the wheel 150 to be able to insert the cord 98 easily around wheel 150, as shown at 158. Weight 148 may be made from a clear or opaque plastic material and provided with a number of small circular indentations 149. At these places bores may be drilled and slugs 151 inserted, if additional weight is required, for instance in the case of very wide blinds.

Figure 24:
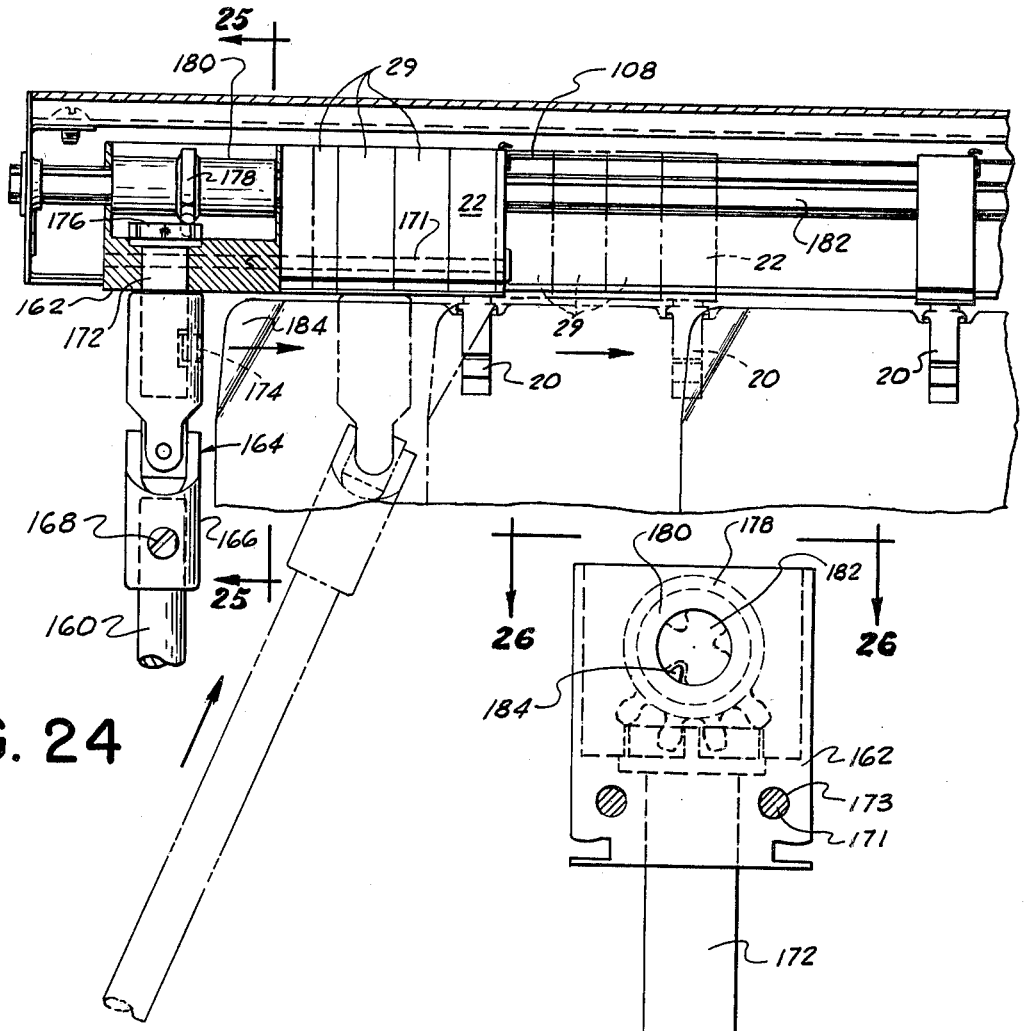
FIG. 24 is a longitudinal section through a blind head of a further embodiment of a vertical blind according to the present invention.
Figure 25:
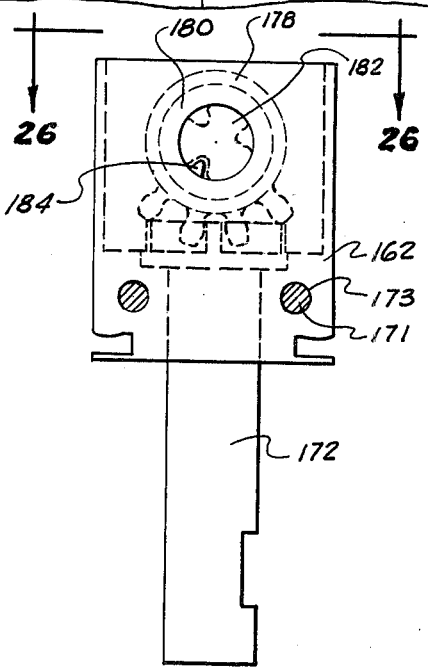
FIG. 25 is an end view of the tilting unit for the blind, as seen in the direction of line 25—25.
Figure 26:
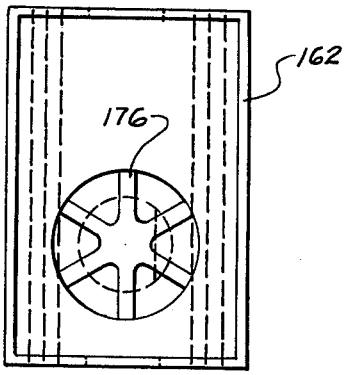
FIG. 26 is a top view as seen in the direction of line 26—26 in FIG. 25, with parts omitted for clarity.

FIG. 24 shows an alternate control for tilting and for traversing the vanes, which differs from that shown in FIGS. 1 to 12 in that the control is effected by a wand 160, rather than by two separate cords 94 and 98 as shown in FIG. 1 and described in the first embodiment of the invention. Wand 160 is connected to a control station 162 via a universal joint 164 which has a first part 166 connected to the wand 160 by means of a screw 168 and a second part 170 connected to a shaft 172 via a screw 174. Shaft 172 is provided with a pinion 176 of a special design shown in FIG. 26. Pinion 176 meshes with a gear 178 which is mounted on or integral with a sleeve 180, which in turn is mounted on a tilt rod 182. Relative rotation of sleeve 180 with respect to tilt rod 182 is prevented by a key 184. In a manner similar to that described in connection with the embodiment of FIGS. 1 to 12, the vertical blind of FIG. 24 comprises carriers 22 which in all essential parts correspond to the carriers 22 described in connection with FIGS. 1 to 12. Thus, rotation of tilt rod 182 results in a tilting of holders 20. The carriers 22 of FIG. 24 do, of course, not require openings for a traverse cord.

A number of "dummy" carriers 29 are interposed between the extreme left carrier 22 and control station 162 to provide sufficient space for proper operation of the blind, i.e. in order to enable the first vane to clear the wand. Fasteners, such as two nails 171, may be passed through holes 173 to connect the last carrier 22 on the left and the dummy carriers 29, to the control unit 162.

Movement of part 170 in the direction of the arrow 184 will result in traversing the vanes of the open blind, and movement in the direction opposite to that of arrow 184 will result in traversing the vanes of the blind closed. Again, the individual carriers 22 are interconnected by spacers 108 described in detail in connection with FIGS. 7 through 9.

A further embodiment of the vertical blind according to this invention is illustrated in FIGS. 27 through 31, which is generally similar to that of FIGS. 1 through 12, except that the control for tilting and for traversing the vanes 18 is arranged on one and the same side of the blind, i.e. the right side in the embodiment illustrated in FIGS. 27 through 31, although of course this arrangement could be reversed and the controls be located on the left side.

Cord 98 for traversing the vertical blind is connected to the extreme left end carrier 22 at 103 and 106 respectively and is passed around a wheel 186 which for ease of rotation is mounted on a pin 188 through the intervention of a ball bearing 190.

The individual strands of cords 94 and 98 are kept properly separated by a cord separator 192 provided with slots 194 and 196 and individual grooves 198 and 200 for respectively receiving the cords 94 and 98.

Figure 32:
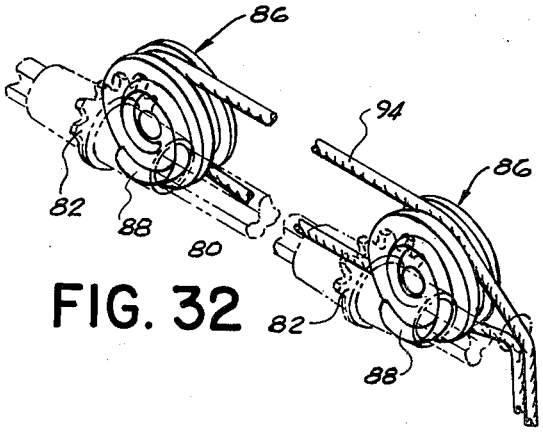
FIG. 32 illustrates a modification of the tilter of FIGS. 7 to 9.
Figure 27:
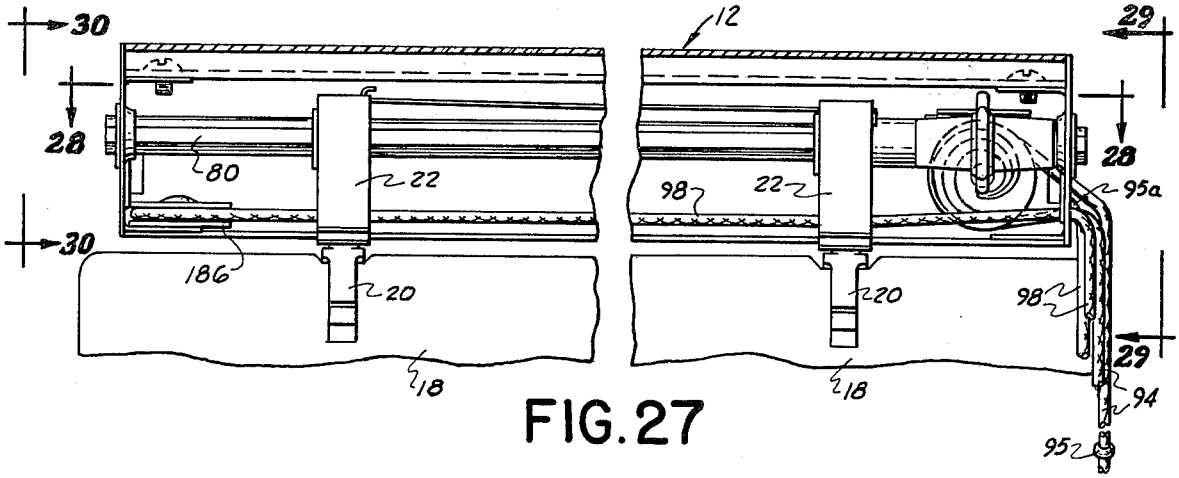
FIG. 27 is a longitudinal section through a vertical blind head showing a further embodiment of the invention.
Figure 28:
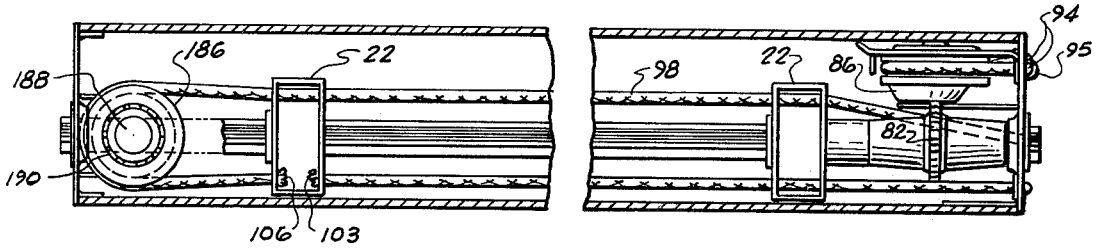
FIG. 28 is a longitudinal sectional view taken along line 28—28 of FIG. 27.
Figure 29:
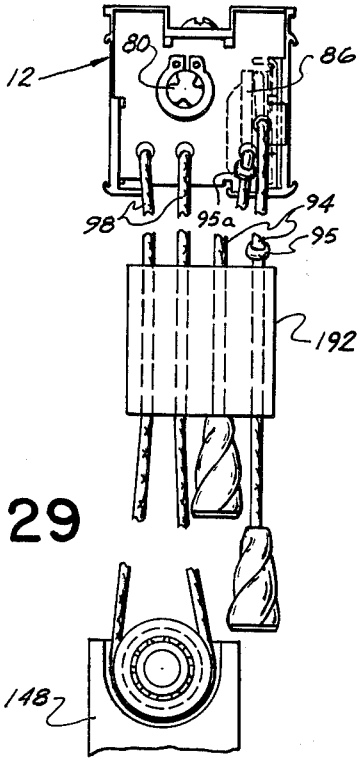
FIG. 29 is a right end view of the head of FIG. 27 as seen in the direction 29—29 of FIG. 27.
Figure 30:
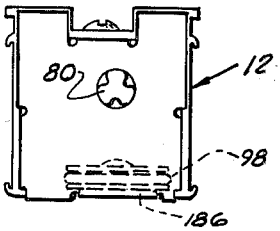
FIG. 30 is a left end view of the blind head according to FIG. 27, as seen in the direction 30—30 of FIG. 27.
Figure 31:
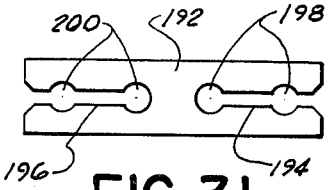
FIG. 31 is a top view of a cord separator.

In the case of a very wide vertical blind it may be advantageous to use two drive units 86, instead of one, for tilting the vanes or slats 18. Such an arrangement is shown in FIG. 32 in which the drive unit 86 shown on the left in FIGS. 7 and 9 is repeated on the right side of the blind. Therefore, there exists a common tilt rod 80 with two gears 82, one at each end, and two worms 88. The tilt cord 94 runs from one end of the blind head, over the disc 90 of the first unit 86, to the disc 90 of the other unit 86 and returns to the first unit.

It is, of course, understood that the invention is not limited to the embodiments shown and/or described in the above specification, but by the scope of the appended claims.

I claim:

1. A vertical blind, comprising: a blind head, a plurality of carriers supported for reciprocating movement in said head, a plurality of holder means respectively supported in said carriers for pivotal movement and respectively adapted to support a plurality of vanes therefrom, and control means for controlling said reciprocating movement of said carriers and for controlling said pivotal movement of said holder means, said control means including rod means rotatably supported in said head, said rod means extending in a substantially vertical plane substantially bisecting said carriers, means for rotating said rod means, a plurality of first bevel gear means respectively rotatably supported in said carriers and mounted for rotation with said rod means in said plane, a plurality of second bevel gear means respectively connected to said holder means and respectively mounted for meshing engagement with said first bevel gear means and having substantially vertical axes of rotation located in said plane, whereby rotation of said rod means by said rotating means will rotate said holder means, each of said carriers comprising seat means for supporting the respective holder means, and also comprising bearing means for rotatably supporting the respective first bevel gear means in a position such that said first bevel gear means holds the respective holding means on said seat means.

2. A vertical blind according to claim 1, wherein said second bevel gear means is integral with said holder means.

3. A vertical blind according to claim 1, wherein said holder means comprises a first shank, a second shank substantially parallel to said first shank and spaced therefrom sufficiently to form a first slot therebetween for receiving a vane to be supported from said holder means, and hook means connected to one of said shanks and adapted to support said vane.

4. A vertical blind according to claim 3, wherein said hook means and said other shank form a second slot therebetween which extends at an acute angle with respect to said one shank and which communicates with said first slot, whereby a vane to be suspended from said hook means is adapted to be introduced through said second slot into said first slot.

5. A vertical blind according to claim 1, wherein said first bevel gear means is provided with means for rotatably interconnecting said first bevel gear means and said rod means.

6. A vertical blind according to claim 1, wherein said means for rotating said rod means comprises a first gear connected to said rod means for rotation therewith, worm gear means rotatably supported in said blind head about an axis perpendicular to the axis of rotation of said rod means, and comprising a worm arranged on said worm gear means for meshing engagement with said first gear.

7. A vertical blind according to claim 6, wherein said first gear is provided with a plurality of teeth extending over a part of the circumference of said first gear only so that said first gear becomes disengages from said worm upon a predetermined angle of rotation of said rod means.

8. A vertical blind according to claim 1, wherein said means for rotating said rod means comprises a first gear mounted on said rod means for rotation therewith, and a second gear supported in said head and rotatable about an axis substantially perpendicular to the axis of rotation of said rod means, said second gear comprising a plurality of substantially radially extending teeth adapted to mesh with the teeth of said first gear.

9. A vertical blind according to claim 8, wherein said control means comprises a carrier supported for reciprocating movement in said head and comprising means for receiving said first gear and said second gear.

10. A vertical blind according to claim 9, comprising a wand, means connected to said second gear for rotation therewith, and a universal joint interposed between last mentioned means and said wand, whereby rotation of said wand will rotate said second gear and thereby said plurality of holder means via said first gear and said first and second bevel gear means.

11. A vertical blind according to any one of claims 6 to 8, wherein said means for rotating said rod means includes a first cord passed around said worm gear means and having two substantially parallel strands extending downwardly from said head when said blind is in operative position, and wherein said control means for controlling said reciprocating movement of said carriers comprises a second cord having two substantially parallel strands extending downwardly when said blind is in operative position, and separator means for separating said strands from each other and conprising a body having a first pair of interconnected parallel grooves for receiving and holding said strands of said first cord, and having a second pair of interconnected parallel grooves for receiving and holding said strands of said second cord.

12. A vertical blind according to claim 11, wherein said body is provided with a first passageway extending along one side of said body and providing access from outside said body to said first pair of grooves and a second passageway extending along another side of said body and providing access from outside said body to said second pair of grooves.

13. A vertical blind according to claim 1, wherein each of said carriers comprises a housing having a front wall, and a rear wall spaced from said front wall when looking in the direction of extension of said rod means, and first and second opening means respectively in said front and rear wall and aligned with each other, for passing a cord therethrough.

14. A vertical blind according to claim 13, wherein each of said opening means comprises a first, circular opening portion of a first diameter, a second circular opening portion of a second diameter smaller than said first diameter, and a third opening portion interconnecting said first and second opening portions and being of a width narrower than the diameter of said second opening portion.

15. A vertical blind according to claim 14, wherein said third portion tapers from said first portion to said second portion.

16. A vertical blind according to any one of claims 13 to 15, wherein said control means for controlling said reciprocating movement of said carriers comprises a cord passing through said opening means of said plurality of carriers and has a first end held within one of said carriers and a second end also held within said one carrier.

17. A vertical blind according to claim 16, comprising weight means attached to said cord for applying tension thereto.

18. A vertical blind according to claim 17, wherein said weight includes a body, a pivot supported by said body, and wheel means rotatably supported by said pivot, said cord passing about said wheel means.

19. A vertical blind according to claim 17, wherein said weight has a body made from a plastic material.

20. A vertical blind according to claim 19, wherein said body is provided with at least one cavity, and at least one metal body respectively inserted in said cavity.

21. A vertical blind according to any one of claims 1 to 4, which comprises a plurality of spacer bands for respectively interconnecting two adjacent carriers, each spacer band comprising a first portion connecting the same to one of said carriers and a second portion slidably received in said adjacent carrier.

22. A vertical blind according to claim 21, wherein at least two adjacent carriers are provided with aligned slots in said front and rear walls of said carriers respectively, and wherein said first portion of said spacer band is connected to one of said walls of one of said carriers and passes through the aligned slot in the other wall of the said one carrier and wherein said second portion is hook-shaped and passes through the slot in said one wall of said adjacent carrier.

23. A vertical blind according to claim 22, wherein said spacer band is provided with a raised portion adjacent said first portion between said front and rear wall of said one carrier.

24. A vertical blind according to claim 21, wherein at least a first, a second and a third carrier are arranged adjacent each other, each carrier being provided with aligned slots in its front and rear walls, and wherein a first spacer band interconnects said first and second carriers, and a second spacer band interconnects said second and third carriers, said first spacer band having its first portion connected to said front wall of said first carrier and passing through said slot in the rear wall of said first carrier, said first spacer band extending through the slot in said front wall of said second carrier, said second spacer band having its front portion connected to said front wall of said second carrier and passing through said slot in said rear wall of said second carrier, said second spacer band extending through the slot in said front wall of said third carrier, said second portions of said first and second spacer bands having hook-shaped ends respectively for preventing said first and second spacer bands from becoming disconnected from said second and third carriers respectively.

25. A vertical blind according to claim 24, wherein said first and second spacer bands are provided with raised portions respectively adjacent their first portions between the front and rear wall of said first and second carrier, respectively.

26. A vertical blind according to claim 1, wherein said head has a front wall and a top wall with a front and rear edge which comprises means for connecting said head to a support, said connecting means comprising plate means provided with a first curved end for connection to said top wall of said rear edge and a second curved end for connection to said front edge, said second curved end being provided with an extension forming a space between said second curved end and said front wall for permitting a tool to be inserted therebetween to remove said second curved end from said front edge and thereby disconnect said blind head from said plate.

27. A vertical blind according to claim 1, comprising a plurality of vanes respectively suspended from said holder means, each of said vanes having a first end portion for connection to the respective holder means, and a second end portion remote from said first end portion and provided with opening means, said opening means comprising a first portion of substantially circular cross section, a second portion spaced from said first portion in the direction away from said first end portion, and a third opening portion interconnecting said first and second opening portions, said second opening portion being non-circular with a first dimension in a substantially vertical direction and a second dimension in a substantially horizontal direction which is greater than said first dimension, the width of said third portion interconnecting said first and second portions being narrower than the diameter of said first portion, and chain means interconnecting said plurality of vanes and extending through said second opening means.

28. A vertical blind according to claim 1, wherein said carriers are arranged in a row in said head, each carrier being provided with two parallel opening means extending therethrough substantially in the direction of reciprocation of said carriers, said control means for controlling said reciprocating movement including a cord having two strands extending respectively through said two opening means and having a first and second end, both ends being connected to one carrier adjacent one end of said blind head, and means connecting an intermediate carrier in said row of carriers with a terminal carrier between said one carrier and said one end of said blind head, whereby pulling of said one carrier by said cord away from said one end of said blind head will push the carriers between said one carrier and the other end of said blind head towards said other end of said blind head until pushing of said intermediate carrier will pull said terminal carrier to thereby provide a support for said cord between said two ends of said head during pulling of said cord.

29. A vertical blind according to claim 1, wherein said means for rotating said rod means comprises a first gear and a second gear respectively mounted adjacent opposite ends of said rod means and connected for rotation therewith, first and second pulley means rotatably supported in said head adjacent opposite ends thereof about axes perpendicular to the axis of rotation of said rod means and a first and a second worm respectively connected to said first and second pully means for meshing engagement with said first and second gear respectively, said control means also including a tilt cord having a first strand extending from one end of said blind head, engaging said first pulley means, extending from said first to said second pulley means and therearound, and a second strand connected to said first strand and returning from said second to said first pulley means, whereby pulling said tilt cord in one direction or the other will rotate both said pulley means.

30. A vertical blind according to claim 1, wherein said blind head has a front wall and a rear wall, and wherein at least one of said walls is provided with means for holding a valance thereto.

31. In a vertical blind having a blind head: at least one carrier supported for reciprocating movement in said head, a holder supported in said carrier for pivotal movement and adapted to support a vane therefrom, a first bevel gear rotatably supported in said carrier in a substantially vertical plane substantially bisecting said carrier, a second bevel gear connected to said holder mounted for meshing engagement with said first bevel gear, and having a substantially vertically extending axis of rotation located in said plane, said carrier comprising a seat for supporting said holder, and a bearing rotatably supporting said first bevel gear in a position such that said first bevel gear holds said holder on said seat.

32. The carrier according to claim 31 comprising: a housing having a front wall, and a rear wall spaced from and parallel to said front wall, and first and second opening means respectively in said front and rear wall and aligned with each other, for passing a cord therethrough.

33. The carrier according to claim 32, wherein each of said opening means comprises a first, circular opening portion of a first diameter, a second circular opening portion of a second diameter smaller than said first diameter, and a third opening portion interconnecting said first and second opening portions and being of a width narrower than the diameter of said second opening portion.

34. The carrier according to claim 33, wherein said third portion tapers from said first portion to said second portion.

* * * * *